United States Patent [19]

Saint Georges Chaumet

[11] 4,301,698

[45] Nov. 24, 1981

[54] DEVICE FOR DEPOSITING A PASTY SUBSTANCE ON A SURFACE AUTOMATICALLY AND AUTOMATIC MACHINE THEREFOR

[75] Inventor: Bertrand Saint Georges Chaumet, La Celle Saint Cloud, France

[73] Assignee: Intrama S.A., Paris, France

[21] Appl. No.: 160,456

[22] Filed: Jun. 18, 1980

[30] Foreign Application Priority Data

Jul. 3, 1979 [FR] France ..... 79 17190

[51] Int. Cl.[3] ..... B25B 23/14

[52] U.S. Cl. ..... 81/468; 118/711

[58] Field of Search ..... 81/468; 118/710, 711, 118/410, 411

[56] References Cited

U.S. PATENT DOCUMENTS

| | | | |
|---|---|---|---|
| 2,533,704 | 12/1950 | Zanetti | 118/711 |
| 2,834,050 | 5/1958 | Dymsza et al. | 118/711 |
| 3,379,167 | 4/1968 | Douglas | 118/711 |
| 3,693,483 | 9/1972 | Palmer et al. | 81/468 |
| 3,719,111 | 3/1973 | Study | 81/468 |
| 3,802,301 | 4/1974 | Peterson | 81/468 |

*Primary Examiner*—James L. Jones, Jr.

*Attorney, Agent, or Firm*—Young & Thompson

[57] ABSTRACT

The device comprises a fluid-tight and flexible reservoir for a pasty substance fixed in a fluid-tight housing, the outlet orifice from this reservoir for the pasty substance including a cut-off valve which can be opened by contact with the surface of an article. The housing is connected to a source of pressurized gas. The housing includes a cylinder and a piston. Apparatus are provided to control the sliding of this piston to the end of a cylinder, so as to extend the nozzle outwards and a spring is provided to bring back the piston into the housing. The invention is useful for marking mass-produced articles.

11 Claims, 5 Drawing Figures

DEVICE FOR DEPOSITING A PASTY SUBSTANCE ON A SURFACE AUTOMATICALLY AND AUTOMATIC MACHINE THEREFOR

BACKGROUND AND GENERAL DESCRIPTION OF THE INVENTION

The present invention relates to a device for depositing on a surface automatically, a pasty substance packaged in a fluid-tight and flexible reservoir.

The invention relates also to an automatic marking machine comprising several of these devices.

The device according to the invention is principally intended for the marking of various articles, the pasty substance contained in the fluid-tight and flexible container being in this case constituted by an ink or a paint.

In other applications of the device according to the invention, this pasty substance may be a grease, a glue, a mastic or other caulking or sealing materials, or again a chemical reactant intended to be deposited on an article.

It is known that, in industry, mass-produced articles must often be marked with spots or lines of ink or of paint, to identify the various parts, to mark defective parts or for any other reason.

This marking may be carried out by a marking device comprising a paint refill including an outlet orifice through which the paint is expelled when the refill is compressed.

In Applicant's French Pat. No. 2 298 444 a semiautomatic marking device is described, in which the paint or ink refill is removably fixed, in a fluid-tight housing connected to a compressed air source. The outlet orifice of this refill includes a nozzle whose end carries a cut-off valve which can be opened by simple contact with the surface to be marked.

The expulsion of the paint through this cut-off valve is produced by controlling the introduction of compressed air into the housing to compress the refill, and by placing the end of the nozzle on the surface to be marked to depress and open the valve.

Such a device can be used, for marking automatically, various articles passing, for example continuously, opposite the outlet nozzle of the refill. For this purpose, this marking device may be associated with means enabling it to be brought intermittently into contact with the successive articles to be marked.

Experience has shown that such a device does not give complete satisfaction. In fact, in order that the marking may be carried out under good conditions and to avoid any deterioration of the cut-off valve of the nozzle of the device, the distance between the surface of the articles to be marked and the device must be regulated very accurately. It is not often possible to effect this adjustment with precision, since the parts to be marked may have variable dimensions, an irregular surface or include similar asperities or defects.

It is an object of the present invention to overcome the drawbacks of known devices, by providing an automatic device, notably for marking articles, which is very convenient in use and can be utilized in numerous fields of industry.

According to the invention the device for depositing on a surface automatically, a pasty substance packaged in a fluid-tight and flexible container comprises a fluid-tight housing surrounding this container, the outlet orifice of the pasty substance of this container being connected to an outlet nozzle including at its end a cut-off valve which can be opened by contact with the surface, and the housing being connected to a source of pressurized gas, means being provided to control the admission of this gas into the housing.

According to the invention, this device is characterised in that the housing comprises a cylinder open at its free end and surrounding the outlet nozzle, a piston made fast to this nozzle mounted slidably inside this cylinder, in that means are provided to actuate the sliding of this piston towards the open end of the cylinder, so as to cause the outlet nozzle to project to the outside of the open end of the cylinder, and in that it comprises also means for returning the piston towards the housing after cessation of the action of the compressed gas.

To deposit the pasty substance on articles, passing for example, continuously opposite the device, it suffices to actuate the introduction of pressurized gas into the housing and into the cylinder to cause the compression of the container of pasty substance and the sliding of the piston towards the article.

Due to this feature, the distance between the cut-off valve of the nozzle of the container and the articles does not need to be adjusted with precision.

It suffices in fact for the stroke of the piston to be sufficient to permit the valve to touch the article. In addition, even if the valve of the nozzle touches the article before the end of the possible travel of the piston, there is no risk of deteriorating the valve, due to the damping effect exerted by the compressed gas.

According to an advantageous feature of the invention, the means for actuating the sliding of the piston comprise means enabling the simultaneous introduction of pressurized gas into the housing and into the cylinder.

In this way the compression of the reservoir of pasty substance and the sliding of the piston towards the article are produced simultaneously.

According to a preferred embodiment of the invention, the aforesaid means are constituted by a communicating passage between the cylinder and the housing.

This feature enables notable simplification of the device. Other features and advantages of the invention will also be apparent from the description which follows to be read with reference to the accompanying drawings of preferred embodiments given purely by way of nonlimiting examples.

DESCRIPTION OF PREFERRED EMBODIMENTS

Figure 1:
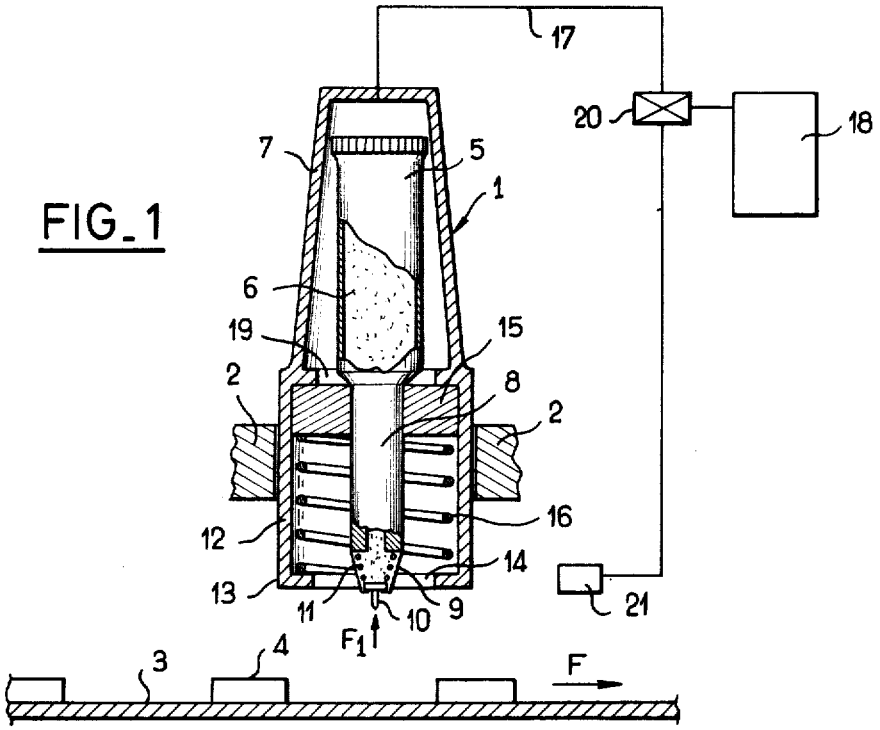
FIG. 1 is a diagrammatic view, in longitudinal section and with portions torn away, of an embodiment of the device according to the invention placed opposite articles to be marked.

In the embodiment shown in FIG. 1, the marking device 1 is mounted at a fixed station on a frame 2 facing a surface 3 on which articles 4 are placed, such as mass-produced mechanical parts, intended to be marked by means of the device.

The surface 3 is constituted, for example, by a conveyor belt moving continuously in the direction of the arrow F.

The marking device comprises a reservoir or tube 5 with a flexible wall containing a pasty marking substance 6, such as a paint or an ink.

This tube 5 is housed in a housing 7 axially surrounding this tube. The tube 5 is fixed to an outlet nozzle 8 for the marking substance 6 bearing at its free end 9 a cut-off valve 10. This valve 10 is held in closed position by a spring 11 lodged inside the free end 9 of the nozzle 8. This valve 10 can be opened by exerting pressure on it in the direction of the arrow F1 (see FIG. 1).

The housing 7 is extended towards the surface 3 by a cylinder 12 including at its free end 13 an opening 14. This cylinder 12 surrounds the outlet nozzle 3 of the tube 6. In this cylinder 12 is slidably mounted, a piston 15 to which the outlet nozzle 3 is made fast. Between this piston 15 and the free end 13 of the cylinder 12 is inserted a return spring 16.

The inside of the housing 7 communicates with the cylinder 12 through an opening 19 of larger diameter than that of the tube 6. The housing 7 is connected through a pipe 17 to a compressed air source 18. The introduction of compressed air 18 into the housing 7 can be controlled by a valve 20, for example electromagnetic, whose opening and closing can be triggered by a detector 21. This detector 21 triggers the opening of the valve 20 as soon as an article is opposite the end 9 of the nozzle 8 of the device 1. This detector 21 actuates the closing of the valve 20 at the end of a predetermined time, according to various parameters, such as the sliding speed of the piston 15 towards the articles 4, the speed of passage of the articles 4, or the nature of the marking desired (in the form of dots or of lines). The detector 21 may be, for example, a feeler known in itself, comprising a lever capable of coming successively into contact with the articles 4 and associated with an electrical switch capable of actuating the opening and closing of the electrovalve 20.

The detector 21 may also be a photoelectric cell sensitive to the presence of articles opposite the nozzle 8 and capable of emitting, by intermittence, electrical signals which can actuate the opening and closing of the valve 20. The closing of the valve 20 may be initiated by a timing device preadjusted as a function of the aforesaid parameters. In addition, in the case where the surface 3 is moved at a constant speed and where the articles 4 are spaced at regular intervals on the surface, the actuation of the opening and the closing of the electromagnetic valve 20 may be assured by successive pulses by means of any suitable devices according to the frequency of the successive presentation of articles 4 opposite the nozzle 8 of the marking device 1.

Figure 2:
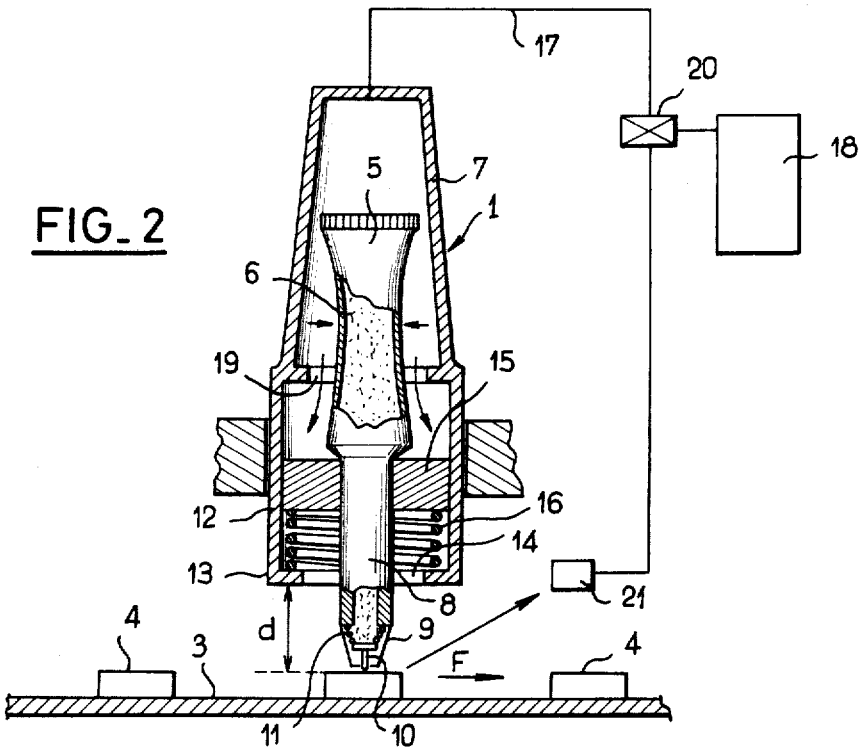
FIG. 2 is a similar view to that of FIG. 1, the device being in the course of operation.

The operation of the marking device 1 is as follows (see FIG. 2):

As soon as an article 4 is presented opposite the nozzle 8 of the tube 5, the detector 21 triggers the opening of the electrovalve 20. The compressed gas 18 introduced into the housing 7 compresses the tube 5 and at the same time pushes the piston 15 towards the article 4. This piston 15 compresses the pin 16 and brings the valve 10 into contact with the article 4. The valve 10 opens, so that the marking substance 6 in the compressed condition escapes from this valve 10 and spreads over the article 4. The contact between the valve 10 and the article 4 is maintained during the whole duration of the opening of the electrovalve 20.

In this way, there is produced on the article 4, a mark in the form of dots or of more or less long lines according to the preadjusted duration of opening of the valve 20.

After the expiry of the preregulated duration of opening of the valve 20, the latter closes. The closing of the valve 20 actuates the escape of compressed air 18 and the withdrawal of the nozzle 8 inside the cylinder 12 under the action of the return spring 16.

The distance d comprised between the free end 13 of the cylinder 12 and the article 4 does not need to be adjusted with great accuracy. It suffices, in fact, for this distance d to be less than the possible travel of the piston 15 to obtain in all cases a contact between the valve 10 and the surface of the articles 4 even if the latter have variable heights or irregular surfaces having asperities or other defects. In addition, in the inactive position, the free end 9 of the nozzle 8 is withdrawn inside the cylinder 12 where it is effectively protected against mechanical shock.

Figures 3, 4:
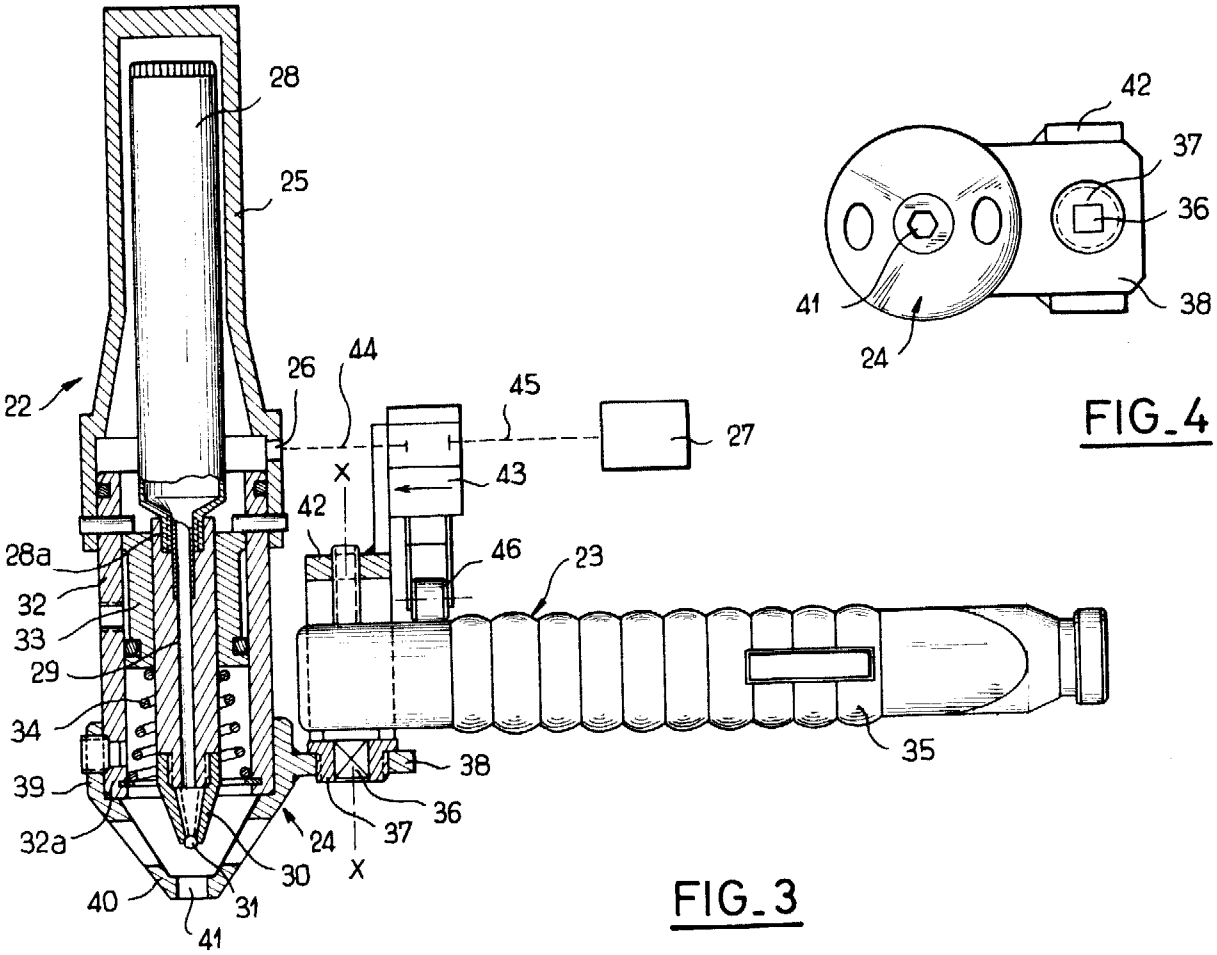
FIG. 3 is a longitudinal sectional view, with a portion torn away, of an embodiment of a marking device associated with a torque wrench.
FIG. 4 is a plan view of the head of the device shown in FIG. 3, the torque wrench being removed.

In the embodiment of FIG. 3, the marking device 22 is fixed to the tightening head 25 of a torque wrench 23. The device 22 includes a fluid-tight housing 25, connected at 26 to a compressed air source 27. Inside the housing 25 is lodged a tube 28 enclosing a marking substance. The mouthpiece 28*a* of this tube 28 is screwed into an outlet nozzle 29 whose free end 30 carries a ball 30 performing the valve function. The housing 25 is fixed in sealed manner to a cylinder 32 in which is slidably mounted, a piston 33 to which the outlet nozzle 29 is made fast. Between this piston 33 and the free end 32*a* of the cylinder 32 is inserted a return spring 34.

The torque wrench 23 comprises a handle 35 whose end carries a finger 36 perpendicular to the handle and of square section, engaged in a recess 37 of complementary cross-section formed in a lateral arm 38 of the tightening head 24. This tightening head 24 has a cylindrical portion 39 screwed to the free end 32*a* of the cylinder 32 and a conical portion 40 whose top, located at a certain distance from the free end 30 of the nozzle 29, includes an opening 41 having a cross-section adapted to that of the nut to be tightened (not shown).

The assembly constituted by the handle 35 and the tightening head 24 is rigid as long as the tightening torque exerted on the nut by pulling the handle 35 has not reached the preadjusted value. When this value is reached, the handle 35 can pivot in manner known in itself around the axis XX' of the finger 36, so that the clamping torque exerted is interrupted. The axis XX' of the finger 36 is mounted on a support 42 made fast to the lateral arm 38 of the tightening head 24. This support 42 bears a valve 43 which is connected through pipes 44, 45, respectively to the housing 25 and to the compressed air source 27.

The opening and closing of this valve 43 may be actuated by a lever 46 which can come into contact with the handle 35 of torque wrench 23, when this handle 35 pivots around the axis XX', that is to say when the desired clamping torque is reached.

The operation of the marking device 22 is as follows:

The opening 41 of the tightening head 24 is engaged on the nut to be tightened, the handle 35 is pulled in the direction of tightening of the nut until the desired tightening torque is produced. When this tightening torque is reached, the handle 35 pivots around the axis XX', comes into contact with the lever 46 of the valve 43, which actuates the opening of the latter. The compressed air 27 introduced into the housing 25 compresses the tube 28 and simultaneously pushes the piston 33 towards the nut engaged in the opening 41 of the tightening head 24. The valve 31 comes into contact with the nut and is opened thereby allowing the marking substance to emerge. This marking substance thus spreads onto the nut. To close the valve 43, it suffices to allow the handle 35 to come back to free the actuating lever 46 of the valve 43. The piston then comes back again under the action of the return spring 34.

The advantage of the device 22 shown in FIG. 3 resides principally in the fact that it enables the marking of any nut which has been tightened by a torque wrench 23 to the prescribed tightening torque.

Thus, on subsequent checking, any nut not marked by the marking substance contained in the tube 28 of the device 22 will be identified as not having been tightened to the value of the tightening torque intended.

The device 22 enables, consequently, the checking of the tightening of the nuts to be considerably facilitated in the manufacture of parts on a large scale.

Figure 5:
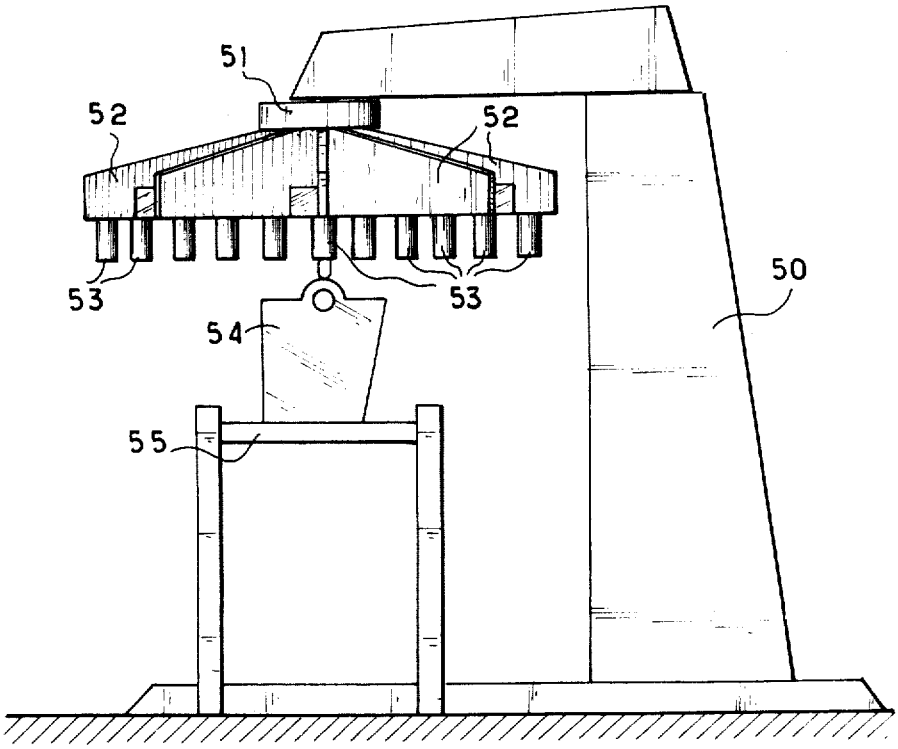
FIG. 5 shows a device according to the invention mounted on a machine for marking the casings of motors at several places.

In the embodiment of FIG. 5, an automatic marking machine is shown enabling simultaneous marking with several color dots to proceed, for example, on the caps of motor housing bearings, for the requirements of manufacturing checks, or of the assembly of parts.

This machine comprises a frame 50 in the form of a jib or angle bracket bearing a wheel 51 with ten spokes 52 mounted in rotation on a vertical axle. In the example shown, each spoke bears six markers, 53, according to the invention. For more clarity, these markers are shown only on two opposite spokes. The wheel 51 with spokes 52 rotates through a tenth of a revolution, for example by means of a hydraulic actuating jack, so as to present the spokes 52 successively opposite successive housings 54 which pass by on the horizontal support 55.

Each spoke or arm 52 receives a low pneumatic pressure (0.5 to 1 bar) for the pressurizing of the paint refills of various markers 53 and the descent of the pistons of the latter on the casing to be marked 54.

The pneumatic actuating and servo-coupling equipment is advantageously housed in the frame 50.

This machine enables six dots of the same color to be produced automatically by associating each spoke 52 of the wheel 51 with this color, or six dots of different colors, each of the markers 53, of one color, being arranged in a different order on each spoke 52 of the wheel 51.

Of course, the invention is not limited to the examples which have just been described, and it is possible to introduce numerous modifications into the latter without departing from the scope of the present invention.

Thus, the device according to the invention may also serve for depositing on a surface, a pasty substance different from a paint or an ink, such as a grease, a glue, a mastic, or a chemical reagent, in order to carry out repetitive continuous operations of lubrication, gluing, masticage or the like.

The device according to the invention may be fixed to any tool performing a predetermined function on an article, and comprising means for actuating the introduction of pressurized gas into the housing and the sliding of the piston towards the article, when the operation of the tool on this article is completed.

The housing 7 of the device 1 or the housing 25 of the device 22 could also be connected to a vacuum source to make the tube 5 or 28 rechargable with pasty substance, in the following manner:

With the aid of pressurizing means independent of suction creating means for the inside of the housing, the piston 15 or 33 is made to slide forwards and the free end 9 or 30 of the device is dipped into a container of small height containing the pasty substance, until the valve 10 or 30 touches the bottom of the container and is opened.

The inside of the housing 7 or 25 is then placed under suction, which has the effect of expanding the flexible walls of the tube 5 or 28, and of causing the suction of the marking substance into this tube 5 or 28.

I claim:

1. Device for automatically depositing on a surface, a pasty substance packaged in a fluid-tight and flexible reservoir, said reservoir being removably fixed in a fluid-tight housing, the outlet orifice from this reservoir for the pasty substance being connected to an outlet nozzle including at its free end a cut-off valve which can be opened by contact with the surface, said housing being connected to a source of pressurized gas and means being provided to control the admission of this gas into the housing, said housing comprising a cylinder open at its free end and surrounding the outlet nozzle, a slidably mounted piston made fast to said nozzle inside said cylinder, means being provided to control the sliding of said piston towards the open end of said cylinder, so as to cause the outlet nozzle to project outside the open end of the cylinder, comprising also means for returning said piston into said housing after the cessation of the action of the pressurized gas.

2. Device according to claim 1, wherein the means for controlling the sliding of the piston comprise means enabling the simultaneous introduction of pressurized gas into the housing and into the cylinder.

3. Device according to claim 2, wherein said means are constituted by a communication between the cylinder and the housing.

4. Device according to claim 1, wherein the return means comprise a spring inserted between the piston and the open end of the cylinder.

5. Device according to claim 1, designed to deposit a pasty substance on a series of articles moving past the open end of the cylinder at a certain distance, the device being mounted at a fixed station, comprising means for controlling the admission of pressurized gas into the housing and the sliding of the piston, when an article is presented facing the open end of the cylinder.

6. Device according to claim 5, designed to deposit spots of pasty substance on said articles, said means acting through successive impulses, according to the frequency of presentation of the articles opposite the device.

7. Device according to claim 5, designed to deposit a continuous line of pasty substance on a surface, said means acting for a predetermined duration corresponding to the length of the continuous line to be deposited on the surface.

8. Device according to claim 1, said device being fixed to a tool performing a predetermined function on an article, said tool comprising means for controlling the admission of pressurized gas into the housing and the sliding of the piston towards the article, when the operation of the tool for this purpose is completed.

9. Device according to claim 3, wherein the open end of the cylinder of the device is fixed removably to a tool to tighten a nut or the like, said tool cooperating with means for controlling the admission of pressurized gas into the housing, and the sliding of the piston towards the nut or the like, when the tightening of the latter is completed.

10. Device according to claim 9, wherein said tool is a torque wrench whose end is fixed removably to a tightening head for a nut, said head being made fast to the open end of the cylinder of the device, said head including facing the valve of the outlet nozzle and at a certain distance from the latter, a tightening recess adaptable to the nut to be tightened, and the torque wrench including a handle which can actuate the control means, for the admission of pressurized gas into the housing and the sliding of the piston towards the nut, when the required tightening torque is reached.

11. Automatic marking machine comprising several devices according to claim 1, said machine comprising a wheel with several spokes rotatably mounted on a frame on a vertical axis, each spoke bearing several marking devices, means being provided to bring the various spokes successively opposite the articles to be marked moving beneath these spokes, so as to continue with the simultaneous marking of several spots on said articles.

* * * * *